US007211029B2

(12) United States Patent
Kau

(10) Patent No.: US 7,211,029 B2
(45) Date of Patent: May 1, 2007

(54) FOLDAWAY THREADMILL

(76) Inventor: Jong Jyr Kau, No. 19, Lane 387, Ming-An Rd., Shin Chuang City, Taipei (TW)

( * ) Notice: Subject to any disclaimer, the term of this patent is extended or adjusted under 35 U.S.C. 154(b) by 643 days.

(21) Appl. No.: 10/627,318

(22) Filed: Jul. 24, 2003

(65) Prior Publication Data

US 2005/0003933 A1 Jan. 6, 2005

(51) Int. Cl.
*A63B 22/02* (2006.01)

(52) U.S. Cl. ..... 482/54

(58) Field of Classification Search ..... 482/54, 482/111–113

See application file for complete search history.

(56) References Cited

U.S. PATENT DOCUMENTS 4,720,093 A * 1/1988 Del Mar ..... 482/52
4,913,396 A * 4/1990 Dalebout et al. ..... 248/649
5,192,255 A * 3/1993 Dalebout et al. ..... 482/54
5,591,106 A * 1/1997 Dalebout et al. ..... 482/54
6,213,919 B1 * 4/2001 Wang et al. ..... 482/54

* cited by examiner

*Primary Examiner*—Stephen R. Crow
(74) *Attorney, Agent, or Firm*—Pro-Techtor Int'l Services

(57) ABSTRACT

A foldaway treadmill is disclosed including: one pair of vertical posts interconnected by one cross bar, one base frame, one tread base, one supporting unit, one or a plurality of pneumatic-hydraulic cylinders, characterized in that, inside the said pneumatic-hydraulic cylinders, there are pneumatic-hydraulic chamber and compressing chamber, separated by piston whereon there is draining-functioned groove, filled with air and oil of suitable proportion to provide more safe, smooth and convenient folding up and out of foldaway treadmill than conventional ones.

3 Claims, 7 Drawing Sheets

FOLDAWAY THREADMILL

BACKGROUND OF THE INVENTION

1. Field of the Invention

The present invention is related to a kind of foldaway treadmill, particularly to a kind of foldaway treadmill which contains designed pneumatic-hydraulic cylinder possessing pneumatic-hydraulic chamber and compressing chamber, separated by piston whereon there is a draining-functioned groove, filled with air and oil of suitable proportion to provide more safe, smooth and convenient folding up and out of foldaway treadmill than conventional ones.

2. Description of Related Art

Due to improper design, the conventional foldaway treadmills have the following problems: poor performance, and lacking perfect safety design to provide safe, smooth and convenient folding up and out.

SUMMARY OF THE INVENTION

The object of the present invention is to provide a foldaway treadmill of lower cost and less complexity, with higher safety and better convenience, including: one pair of vertical posts with two holders, projecting from base frame and interconnected by one cross bar; one base frame containing one pair of wheels and shock-proof pad; one tread base containing rotatory tread belt, powered driver, fixing switch handles, fixing tips, and one pair of wheels; and one supporting unit containing four connecting plates, three or more cross bars, one rotating axle, and one or a plurality of pneumatic-hydraulic cylinders; characterized in that, inside the said pneumatic-hydraulic cylinders, there are pneumatic-hydraulic chamber and compressing chamber, separated by piston whereon there is a draining-functioned groove, filled with air and oil of suitable proportion to provide more safe, smooth and convenient folding up and out of foldaway treadmill than conventional ones.

LIST OF REFERENCE NUMERALS

Figure 1:
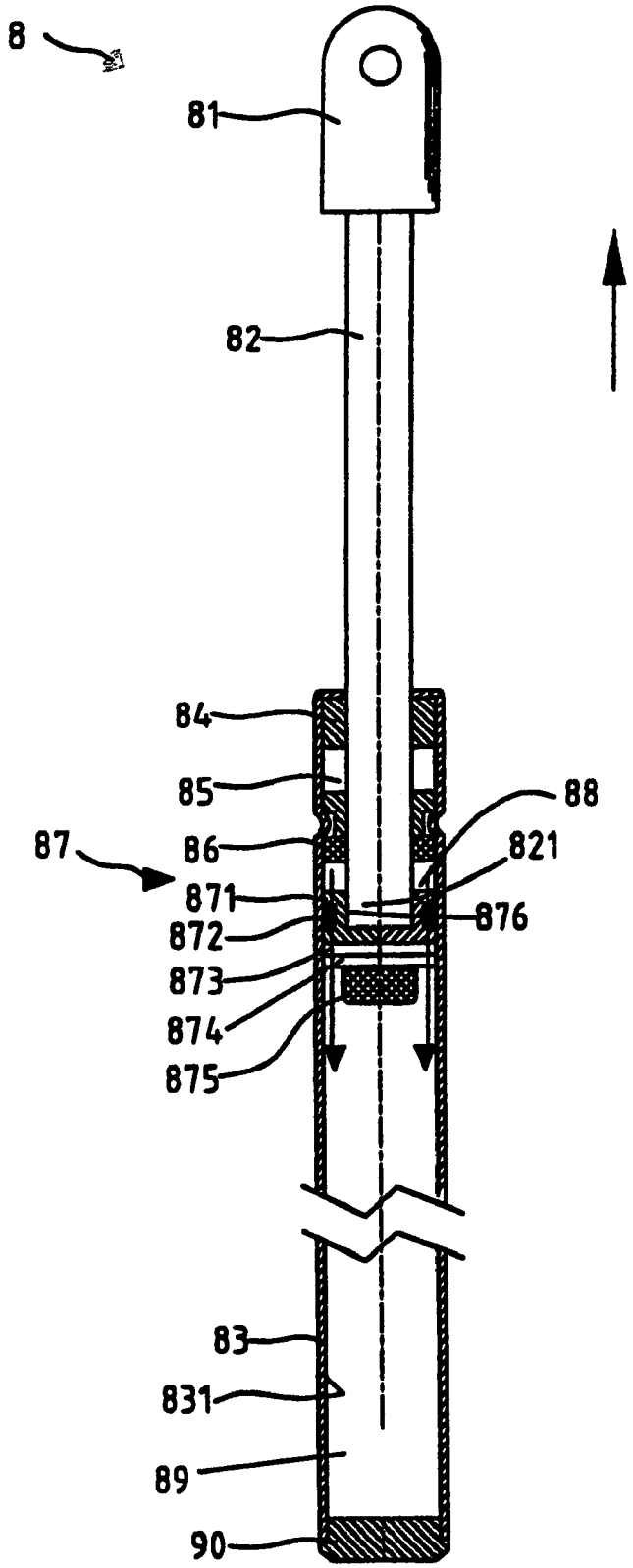
FIG. 1 illustrates sectional view of pneumatic-hydraulic cylinder.

5 vertical post
- 51 cross bar
- 52 holder

6 treadmill base
- 60 cross bars
- 61 rotatory tread belt
- 62 fixing switch handle
- 63 fixing tip
- 64 wheel of tread base

7 supporting unit
- 71 rotating axle
- 72 pivoting axle
- 73 pivoting axle
- 74 first connecting plate
- 76 cross bar
- 77 second connecting plate

8 pneumatic-hydraulic cylinder unit
- 81 upper end of pneumatic-hydraulic cylinder
- 82 piston rod
  - 821 lower end of piston rod
- 83 cylinder
  - 831 cylinder inner wall
- 84 upper cylinder cover
- 85 oil seal
- 86 fixing sleeve
- 87 piston unit
  - 871 piston
  - 872 o-ring
  - 873 washer
  - 874 special washer
  - 875 screw nut
  - 876 draining-functioned groove
- 88 compressing chamber
- 89 pneumatic-hydraulic chamber
- 90 lower cylinder cover
- 91 lower end of pneumatic-hydraulic cylinder

10 driving roller

11 base frame

12 cross bar of base frame

13 shock-proof pad

14 wheel of base frame

DETAILED DESCRIPTION OF THE PREFFERED EMBODIMENTS

The present invention provides a foldaway treadmill of lower cost and less complexity, with higher safety and better convenience, by means of utilizing designed pneumatic-hydraulic cylinder which contains pneumatic-hydraulic chamber and compressing chamber, separated by piston whereon there is a draining-functioned groove, filled with air and oil of suitable proportion, to supply smooth and modified buffering force when folding up or out foldaway treadmill of the present invention by just lifting or pulling down treadmill slightly, and consequently more safe, smooth and convenient folding up and out of foldaway treadmill than conventional ones.

Figure 4:
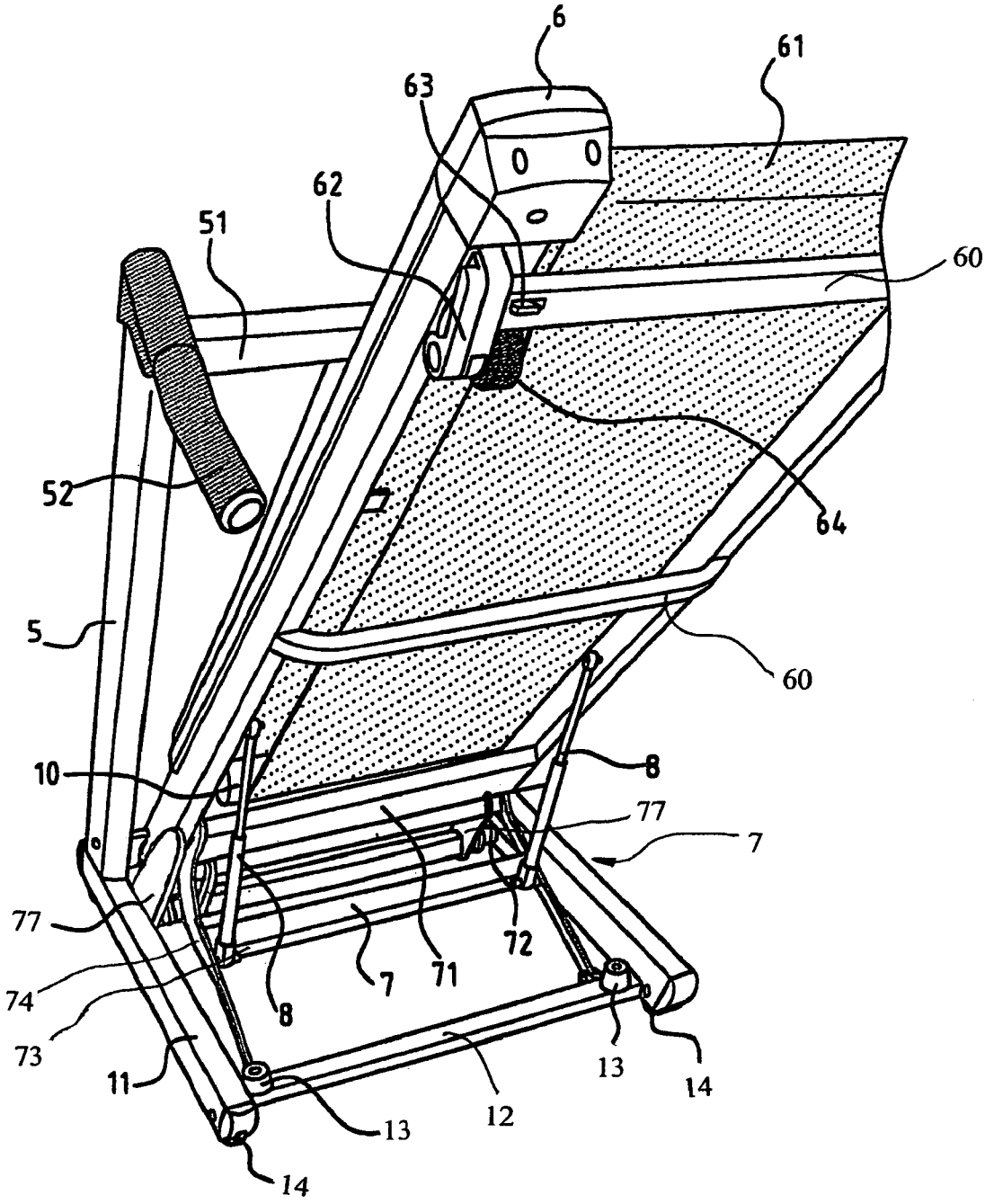
FIG. 4 illustrates perspective view of foldaway treadmill of the present invention.

As illustrated in FIG. 4, foldaway treadmill of the present invention is made of steel tubes, which contains vertical posts 5, base frame 11, tread base 6, supporting unit 7, pneumatic-hydraulic cylinder unit 8, driving roller 10.

The each said vertical post 5 projects upwards from each front end of base frame 11, with a cross bar 51 interconnecting right and left vertical post 5, and with each vertical post 5 having a holder 52.

The said tread base 6 includes: a plurality of cross bars 60 interconnecting both longitudinal sides of tread base 6, one rotatory tread belt 61, two fixing switch handles 62 located at each rear end of tread base 6, two fixing tips 63 which extruding out to contact ground and keep the whole setup firmly positioned when pulling down fixing switch handles 62, and two wheels 64 located at each rear end of tread base 6.

The said supporting unit 7 includes: one cross bar 76; one rotating axle 71; a plurality of pivoting axles 72, 73; two first connecting plates 74, each front end of which is pivoted to the corresponding front end of tread base 6 with the said rotating axle 71 spanning through both pivoting holes, and each rear end of which is pivoted to corresponding end of cross bar 12 which interconnects both rear ends of base frame 11; two second connecting plates 77, each upper end of which is pivoted to the corresponding front end of tread base 6 with the said rotating axle 71 spanning through both pivoting holes, and each lower end of which is pivoted to corresponding front end of base frame 11 with the said pivoting axle 72 spanning through both pivoting holes; two said pneumatic-hydraulic cylinder unit 8, each upper end 81 of which is pivoted to the suitable position of each said tread base 6's longitudinal side, and each lower end 91 of which is pivoted to corresponding end of said pivoting axle 73 spanning between two first connecting plates 74; the said cross bar 76 interconnecting two front end of said first connecting plates 74.

As illustrated in FIG. 1, the said pneumatic-hydraulic cylinder 8 includes: a cylinder body 83; piston rod 82; piston unit 87 engaged to piston end 821, through which piston 871, washer 873, special washer 874 are mounted, and to which a nut 875 threadedly engaged; an annular groove 876 on piston's column face, to which an o-ring 872 is engaged with inner wall 831 of cylinder body 83 air-tightly contacted.

The piston rod 82 extends through the central holes of upper cylinder cover 84, oil seal 85, fixing sleeve 86, with the rod end connecting upper end element which connects to a suitable position of the said treadmill alternatively.

The said pneumatic-hydraulic cylinder 8 has a pneumatic-hydraulic chamber 89 located within a space between the said piston unit 87 and lower end cover, and a compressing chamber 88 located within a space between the said piston unit 87 and fixing sleeve 86, with drainage between each other to achieve balance of compressed air and oil of preset quantity during moving of piston rod 82.

Figure 2:
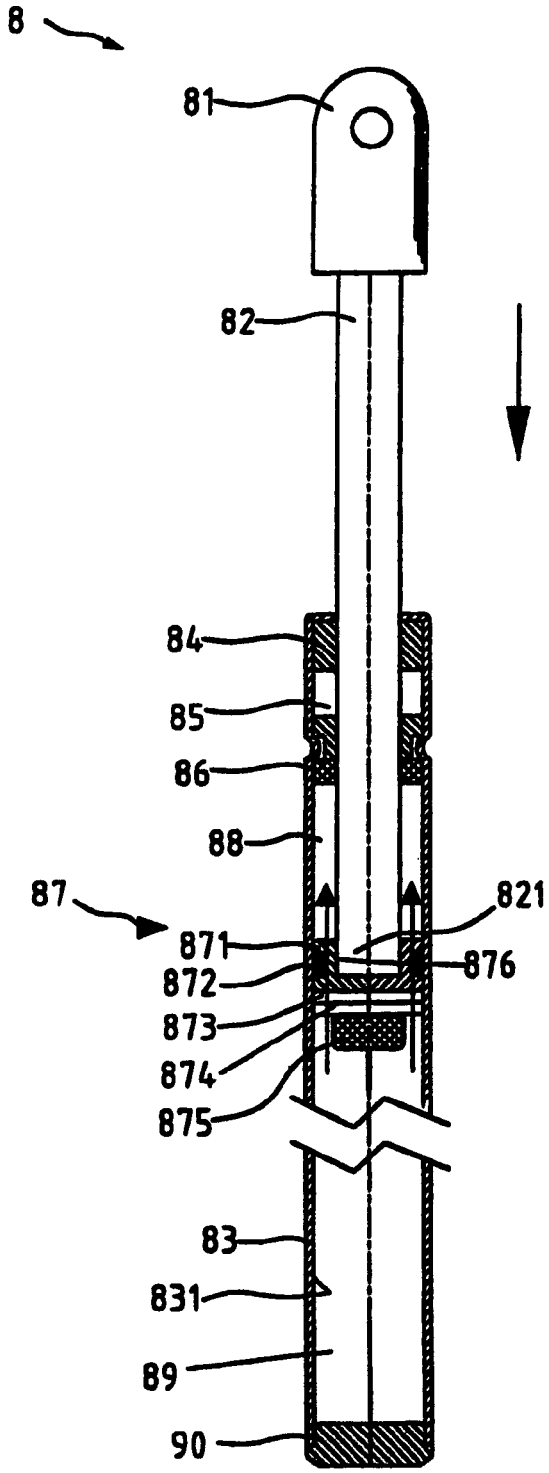
FIG. 2 illustrates sectional view of pneumatic-hydraulic cylinder in extending state.

When folding up the foldaway treadmill of present invention (at this moment, the said compressing chamber 88 full of compressed air and oil of preset quantity under load of tread base 6's weight), just lifting up the said tread base 6 slightly from shock-proof pad 13 will make compressed air and oil of preset quantity inside compressing chamber 88 drain through groove 876 on piston 871 into pneumatic-hydraulic chamber 89, as indicated by arrows in FIG. 2.

As the gap of said groove 876 is designed to regulate speed of draining, the said tread base 6 will rise slowly and smoothly until touching said cross bar 51 of the said vertical post 5.

Figure 3:
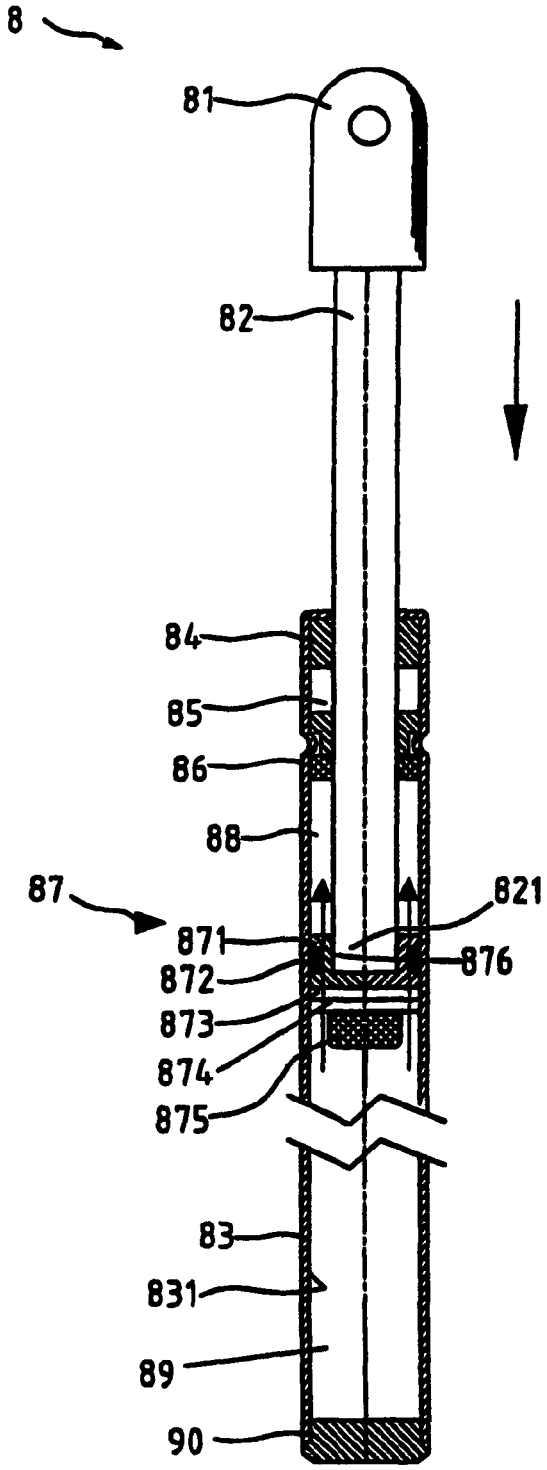
FIG. 3 illustrates sectional view of pneumatic-hydraulic cylinder in retracting state.

When one wants to use foldaway treadmill of the present invention and folds it out, just pulling away said tread base 6 slightly from said cross bar 51 of the said vertical post will make piston rod 82 squeeze space of pneumatic-hydraulic chamber 89, and compressed air and oil of preset quantity drains through groove 876 into compressing chamber 88, as indicated by arrows in FIG. 3.

Figure 5:
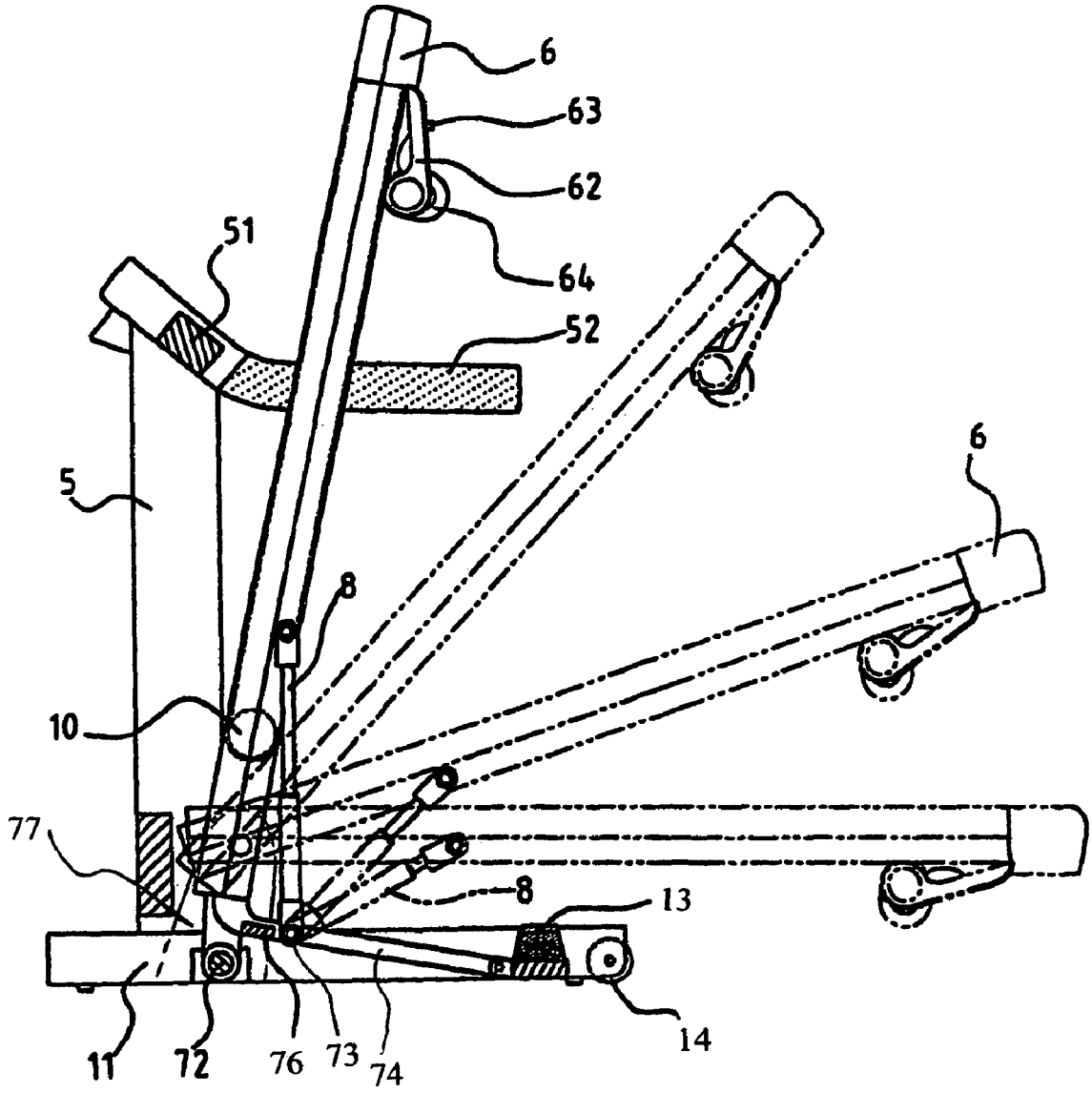
FIG. 5 illustrates motion perspective view of foldaway treadmill of the present invention.

As illustrated in FIG. 5, before reaching pressure balance, the said tread base 6 continues to descend slowly and smoothly. Once all the air in pneumatic-hydraulic chamber 89 exhausted, the said tread base 6 reaches the safe positioning point, and at this moment, what remains inside the said pneumatic-hydraulic chamber 89 is all oil, and the oil will continue to drain into the said compressing chamber 88 through the said groove 876 under the load of the said tread base 6's weight.

As the draining speed of oil through groove 876 is less than air, after the said safe positioning point, the said tread base 6 will descend even more slowly than before the said safe positioning point, and there is a second stage of even more slow folding after the said safe positioning point until all the oil inside the said pneumatic-hydraulic chamber 89 is exhausted completely and the said tread base 6 contacts the said shock-proof pad 13. By deliberately calculating, on the said tread base 6's contacting the said shock-proof pad 13, all the oil inside the said pneumatic-hydraulic chamber 89 is just exactly exhausted completely, and the said tread base 6 stays firmly on the said shock-proof pad 13.

If the oil inside the said pneumatic-hydraulic chamber 89 is exhausted before the said tread base 6 contacting the said shock-proof pad 13, there is a gap between the said tread base 6 and the said shock-proof pad 13, and it will make structure of supporting unit damaged easily.

There are wheels 14 in the rear ends of base frame, and wheels 64 in the rear ends of tread base, once the foldaway treadmill of the present invention folded out, the said treadmill can be moved to suitable place, and then can be positioned firmly with fixing tips extruding out by pressing down fixing switch handles 62.

Figure 6:
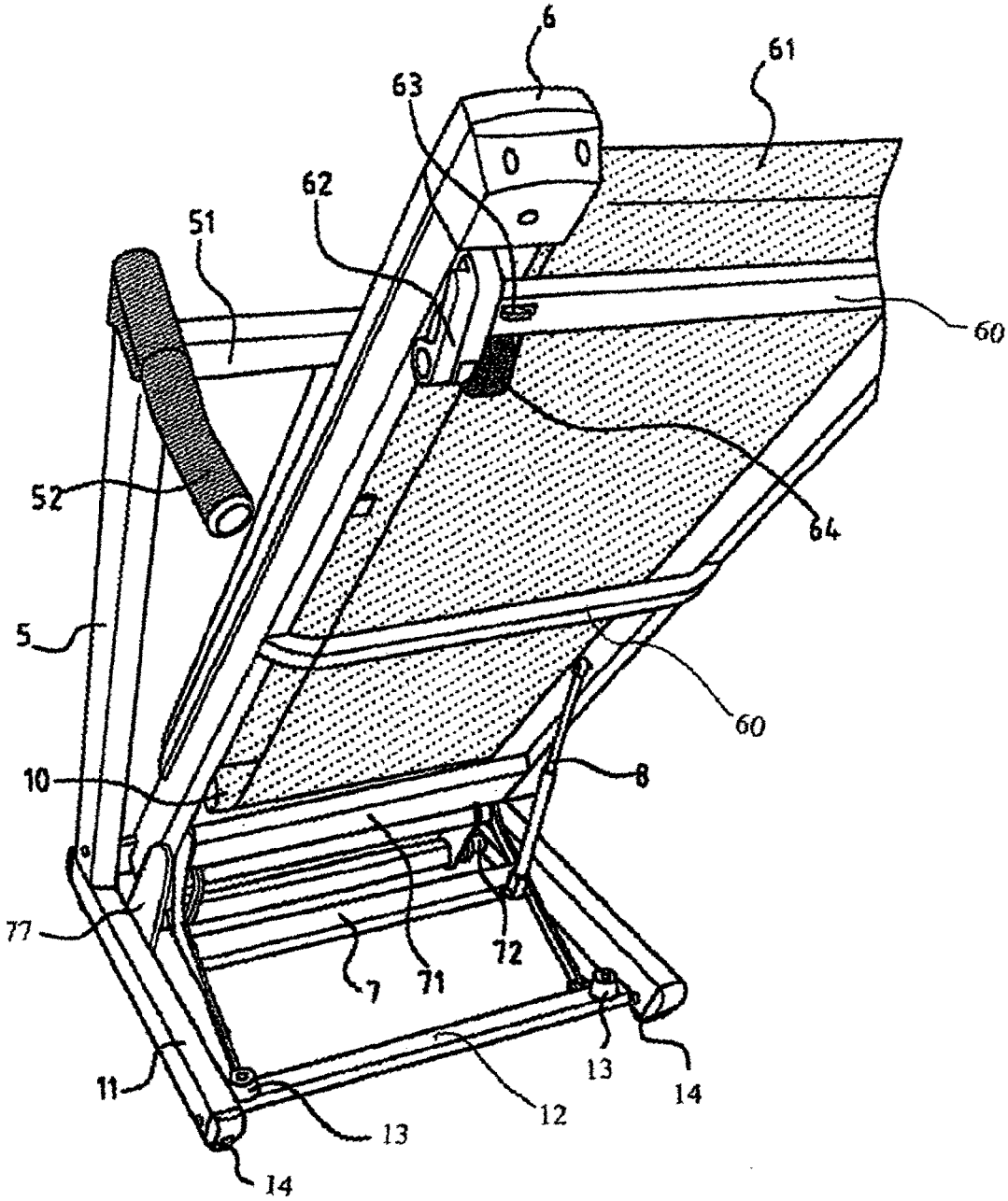
FIG. 6 illustrates perspective view of another embodiment of foldaway treadmill of the present invention.

As illustrated in FIG. 6, the foldaway treadmill of present invention may also utilizes only one pneumatic-hydraulic cylinder to achieve smooth folding up and out.

Figure 7:
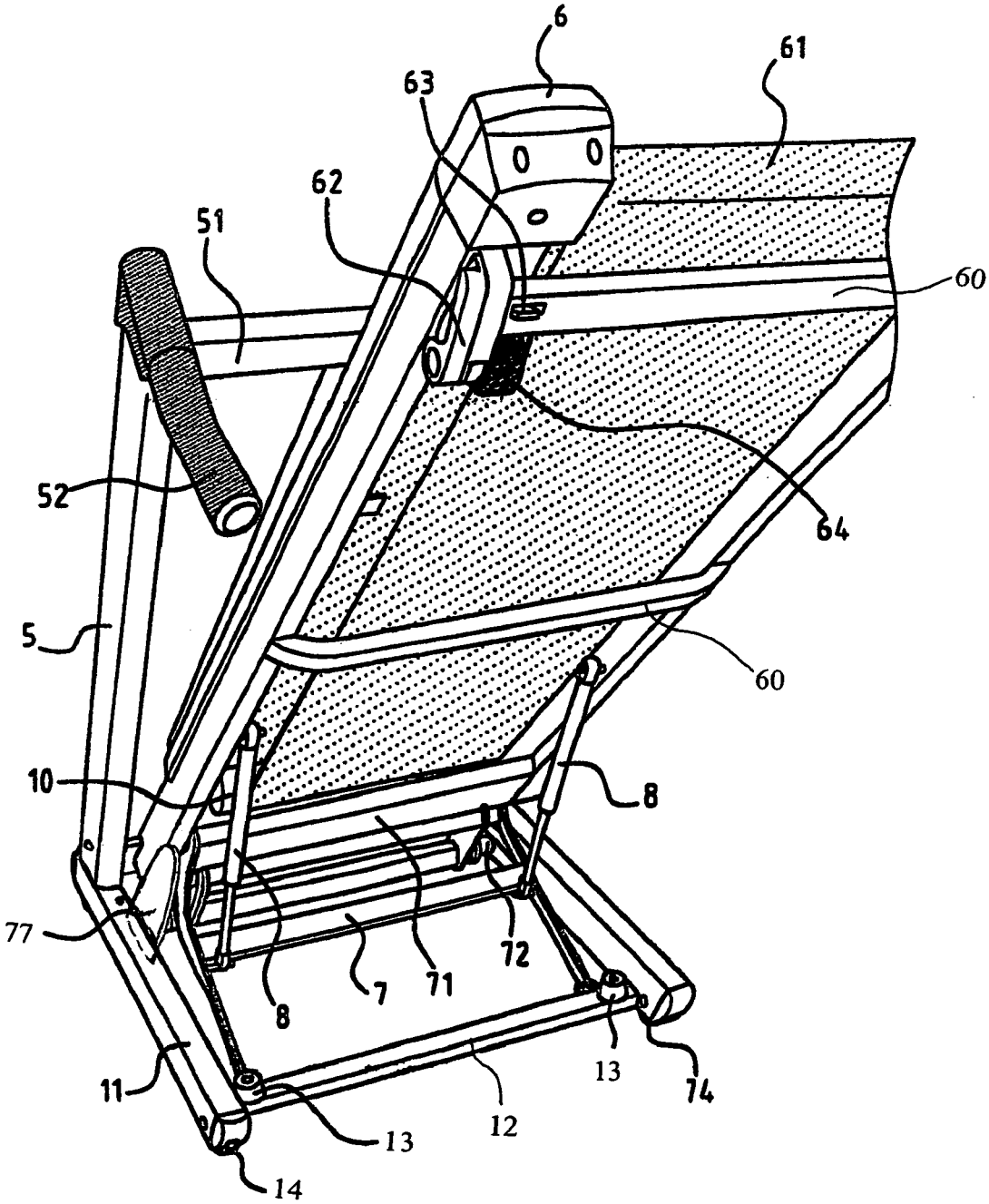
FIG. 7 illustrates perspective view of the further embodiment of foldaway treadmill of the present invention.

As illustrated in FIG. 7, the foldaway treadmill of present invention may also utilizes pneumatic-hydraulic cylinders fixed in reverse direction to achieve the same object of folding up and out smoothly.

While the present invention has been described with reference to the preferred embodiments thereof, it is to be understood that modifications and variations may be easily made without departing from the spirit of this invention which is defined by the appended claims.

What is claimed is:

1. A foldaway treadmill comprising:

a base frame having two longitudinal rods and a cross bar connected between the two longitudinal rods;

a vertical post projects upwards from each front end of base frame with a cross bar arranged between two lateral rods of the vertical post, and one end of each longitudinal side bar having a handle.

a tread base including two longitudinal side bars and a plurality of cross bars connecting between the longitudinal sides of tread base, one rotatory tread belt arranged between the two longitudinal side bars, two fixing switch handles; two fixing tips and two wheels; wherein each of the two fixing switch handles is located at a rear end of a respective one of the two longitudinal side bars of the tread base, the two fixing tips are located at a rear one of the cross bars and near an inner side of a respective one of the two fixing switch handles and is capable of contacting the ground and causing the tread base to be firmly positioned when the fixing tips are pulled downward, and two wheels located at the inner sides of the fixing switching handles;

a supporting unit including one cross bar arranged between the two longitudinal side bars; one rotating shaft arranged between the two longitudinal side bars; a plurality of pivoting shafts; two first connecting plates, and second connecting plates wherein each front end of the first connecting plates is pivoted to the corresponding front end of tread base with the said rotating shaft passing through pivoting holes of the first connecting plates and then entering into the two longitudinal side bars, and a rear end of each first connecting plate is pivoted to a corresponding end of a cross bar which is arranged between both rear ends of the base frame; each upper end of two second connecting plates is pivoted to the corresponding front end of the tread base with said rotating shaft passing through the pivoting holes of the two second connecting plates, and each lower end of the second connecting plates is pivoted to a corresponding front end of said base frame with said pivoting shaft passing through both pivoting holes of the second connecting plates; and two pneumatic-hydraulic cylinder units, each upper end of which is pivoted to a respective one of the two longitudinal side bars of the tread base, and each lower end pivoted to a corresponding end of the pivoting shaft passing between said two first connecting plates; a cross bar being arranged between two front ends of the first connecting plates.

2. The foldaway treadmill as claimed in claim 1, wherein the pneumatic-hydraulic cylinder comprises a cylinder body; a piston rod; a piston unit engaged to a piston end of the piston rod and including a piston, washers, and a nut threadedly engaged to the piston unit.

3. The foldaway treadmill as claimed in claim 1, wherein the pneumatic-hydraulic cylinder has a pneumatic-hydraulic chamber located within a space between the piston unit and a lower end cover, a fixing sleeve and a compressing chamber is located within a space between the piston unit and the fixing sleeve.

* * * * *